US011731667B2

(12) United States Patent
Debost et al.

(10) Patent No.: US 11,731,667 B2
(45) Date of Patent: Aug. 22, 2023

(54) RAIL ENGINE WITH TECHNICAL EQUIPMENT ATTACHMENT DEVICE

(71) Applicant: SpeedInnov, Paris (FR)

(72) Inventors: Pierre Debost, Gennevilliers (FR); Paul Preiss, Reichshoffen (FR); Christophe Raulet, Saint Maurice Colombier (FR); Guy Delitot, Belfort (FR); Eric Bocher, Triel sur Seine (FR)

(73) Assignee: Speedinnov, Paris (FR)

( * ) Notice: Subject to any disclaimer, the term of this patent is extended or adjusted under 35 U.S.C. 154(b) by 263 days.

(21) Appl. No.: 17/154,886

(22) Filed: Jan. 21, 2021

(65) Prior Publication Data

US 2021/0229711 A1 Jul. 29, 2021

(30) Foreign Application Priority Data

Jan. 23, 2020 (FR) ..... 20 00631

(51) Int. Cl.
*B61D 17/10* (2006.01)
*B61C 17/00* (2006.01)
(Continued)

(52) U.S. Cl.
CPC ..... *B61C 17/00* (2013.01); *B61C 3/00* (2013.01); *B61C 17/04* (2013.01); *B61D 15/00* (2013.01); *B61D 17/10* (2013.01); *B61D 37/00* (2013.01)

(58) Field of Classification Search
CPC ..... B61D 15/00; B61D 17/10; B61D 17/270018; B61D 37/00; B61D 37/003; B61C 3/00; B61C 17/00; B61C 17/04
See application file for complete search history.

(56) References Cited

U.S. PATENT DOCUMENTS 9,854,702 B2 12/2017 Stoff
10,864,925 B2 12/2020 Debost et al.
(Continued)

FOREIGN PATENT DOCUMENTS

CN 103280696 9/2013
CN 110509938 11/2019
(Continued)

OTHER PUBLICATIONS

Preliminary Search Report for FR 20 00631 dated Oct. 1, 2020.

*Primary Examiner* — S. Joseph Morano
*Assistant Examiner* — Cheng Lin
(74) *Attorney, Agent, or Firm* — B. Aaron Schulman, Esq.; Stites & Harbison, PLLC

(57) ABSTRACT

The present invention concerns a railway power car comprising: A body (12) extending in a longitudinal direction (X) and defining a technical room (22); and cabinets (15) accommodated in the technical room.

The power car comprises at least two rails (28) disposed on the floor, each of said rails extending in the longitudinal direction, an upper part (42) of each of said rails forming a first means of joining with a cabinet;

each cabinet comprises at least one foot (56), said or each foot comprising a second means of joining (60, 62) capable of mating with the first means of joining of one of said rails, each first means of joining and each second means of joining being configured so that each cabinet can be fastened to said corresponding rail at an infinite number of positions along said rail.

9 Claims, 3 Drawing Sheets

(51) Int. Cl.

| | |
|---|---|
| ***B61D 15/00*** | (2006.01) |
| ***B61C 3/00*** | (2006.01) |
| ***B61C 17/04*** | (2006.01) |
| ***B61D 37/00*** | (2006.01) |

(56) References Cited

U.S. PATENT DOCUMENTS

| | | | | |
|---|---|---|---|---|
| 2014/0318410 | A1 | 10/2014 | Kral et al. | |
| 2015/0166082 | A1 * | 6/2015 | Kanda | B61C 17/04 454/84 |
| 2016/0345460 | A1 | 11/2016 | Stoff | |
| 2018/0223746 | A1 | 8/2018 | Horsley et al. | |
| 2019/0061786 | A1 | 2/2019 | Debost et al. | |

FOREIGN PATENT DOCUMENTS

| | | | | | |
|---|---|---|---|---|---|
| CN | 110509938 | A * | 11/2019 | | B61D 35/00 |
| DE | 102012206663 | | 10/2013 | | |
| EP | 0 360 585 | | 3/1990 | | |
| EP | 2570322 | A1 * | 3/2013 | | B61D 17/10 |
| FR | 2 979 316 | | 3/2013 | | |
| GB | 798 228 | | 7/1958 | | |
| RU | 2669754 | | 10/2018 | | |
| RU | 2672437 | | 11/2018 | | |
| WO | WO-2010108775 | A2 * | 9/2010 | | B61D 35/00 |
| WO | WO 2015/044077 | | 4/2015 | | |
| WO | WO-2015044077 | A1 * | 4/2015 | | B61C 17/00 |

* cited by examiner

RAIL ENGINE WITH TECHNICAL EQUIPMENT ATTACHMENT DEVICE

The present invention relates to a railway power car, particularly for the transport of passengers, of the type comprising: A body extending in a longitudinal direction, the body comprising a floor and two side walls defining a technical room; and cabinets accommodated in the technical room, said cabinets being intended to house electrical and/or electronic and/or pneumatic equipment.

Such a railway power car is, for instance, described in the document EP3453584 in the name of the Applicant.

Such railway power cars generally comprise longitudinal structures fastened to the floor of the technical room, commonly known as sills. These structures are intended to support the electrical cabinets and provide trays for cables and pneumatic hoses.

These longitudinal structures exhibit very slatted shapes, defined specifically for each cabinet location. Each type of power car therefore requires creating a unique sill for the technical room.

The purpose of the present invention is to propose a standardized device capable of replacing sills, making it possible to use the same structure in multiple locations of the power car and/or in multiple different types of power cars.

To that end, one object of the invention is a railway power car of the aforementioned type, comprising at least two rails placed on the floor, each of said rails extending in the longitudinal direction, preferably with a substantially constant cross-section, an upper part of each of said rails forming a first means of joining with a cabinet. Each cabinet comprises at least one foot, said or each foot comprising a second means of joining capable of mating with the first means of joining of one of said rails. Each first means of joining and each second means of joining are configured so that each cabinet can be fastened to said corresponding rail at an infinite number of positions along said rail.

According to other advantageous aspects of the invention, the railway power car comprises one or more of the following features, taken alone or in any technically possible combination:

- the upper part of each of the rails exhibits a substantially constant cross-section in the longitudinal direction, the upper parts of all the rails preferably being substantially identical;
- the upper part of each of the rails exhibits a slot extending in the longitudinal direction and oriented upward;
- the second means of joining of the at least one foot of each cabinet is capable of being disposed in a tightened configuration and a loosened configuration, such that, in the loosened configuration, the second means of joining is able to slide into the slot of the upper part of one of the rails; and in the tightened configuration, the corresponding foot is translationally fixed relative to said rail;
- each rail comprises a lower part, said lower part exhibiting a constant cross-section so as to be able to manufactured from a single piece by extrusion and/or bending in the longitudinal direction, the lower parts of all the rails preferably being substantially identical;
- two of the rails are disposed on either side of a central corridor extending in the longitudinal direction in the technical room, the cabinets being disposed along the side walls on both sides of said central corridor;
- the railway power car further comprises a gutter disposed on the floor in the central corridor, said gutter extending in the longitudinal direction with a substantially constant cross-section, said gutter being intended to accommodate equipment cables and/or channels of the power car;
- the gutter comprises perforations disposed, preferably at regular intervals, in the longitudinal direction;
- the railway power car further comprises plates assembled above the gutter and distributed along the longitudinal direction.

The invention further pertains to a railway vehicle comprising a railway power car as described above.

The invention will be better understood on reading the following description, which is given only as a non-limiting example and references the drawings, in which.

Figure 1:
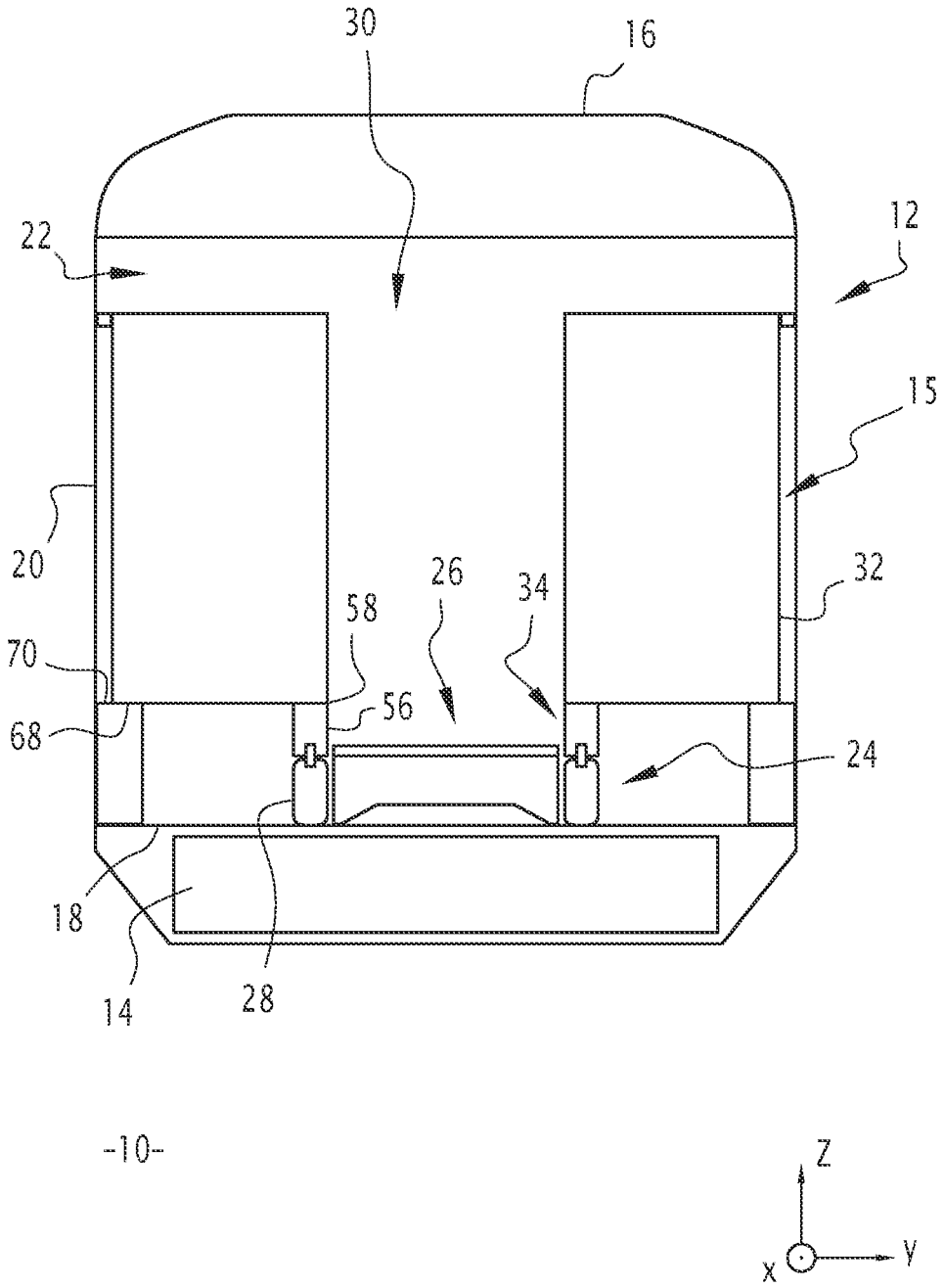
FIG. 1 is a cross-sectional schematic view of a power car according to one embodiment of the invention.

FIG. 1 depicts a railway power car 10, or railway locomotive, according to one embodiment of the invention. The power car 10 is intended to be joined to rail vehicles of the passenger transport car type, to form a train. The power car 10 is preferably a hyper-speed train power car or a locomotive pulling passenger or freight cars.

The power car 10 comprises a body 12, as well as at least two bogies (not depicted) and at least one traction motor 14 disposed under said body 12. The traction motor 14 is intended to set the wheels of the bogies in motion. The power car 10 further comprises a plurality of technical cabinets 15.

The body 12 comprises a roof 16 and a floor 18, which vertically delimit said body. The bogies and the traction motor 14 are disposed under the floor 18. The body 12 further comprises side walls 20.

The body 12 has an elongated shape. Let us take an orthonormal basis (X, Y, Z) in which the direction Z represents the vertical. The body 12 primarily extends in the direction X, corresponding to a usual direction of travel for the power car 10.

The body 12 comprises a technical compartment 22 cross-sectionally depicted in FIG. 1.

The technical compartment 22 particularly comprises: A first device 24 of removable joining; and a cable tray 26.

The first device 24 is intended to removably join with the technical cabinets 15. The first device 24 comprises two rails 28, which are fastened to the floor 18 and extend along X. The two rails 28, which are substantially identical, will be described in greater detail below.

A space located between the two rails 28 along Y defines a central corridor 30 in the technical compartment 22. Advantageously, said central corridor 30 has a width according to Y of between 500 mm and 750 mm, preferably equal to about 750 mm. This width is determined to allow an operator to comfortably pass through, without substantially limiting the volume available for the equipment of the power car 10.

The cable tray 26 extends along X and is fastened to the floor 18 in the central corridor 30 between the two rails 28. The cable tray 26 will be described in greater detail below.

The technical cabinets 15 are installed in the technical compartment 22 near the side walls 20, on both sides of the central corridor 30.

Each technical cabinet 15 comprises a box 32 and a second device 34 for removable joining with the body 12. The box 32 has a substantially rectangular shape and is intended to house electrical and/or electronic equipment of the power car 10. In one variant, the box 32 is intended to house pneumatic equipment, such as hoses.

Figure 2:
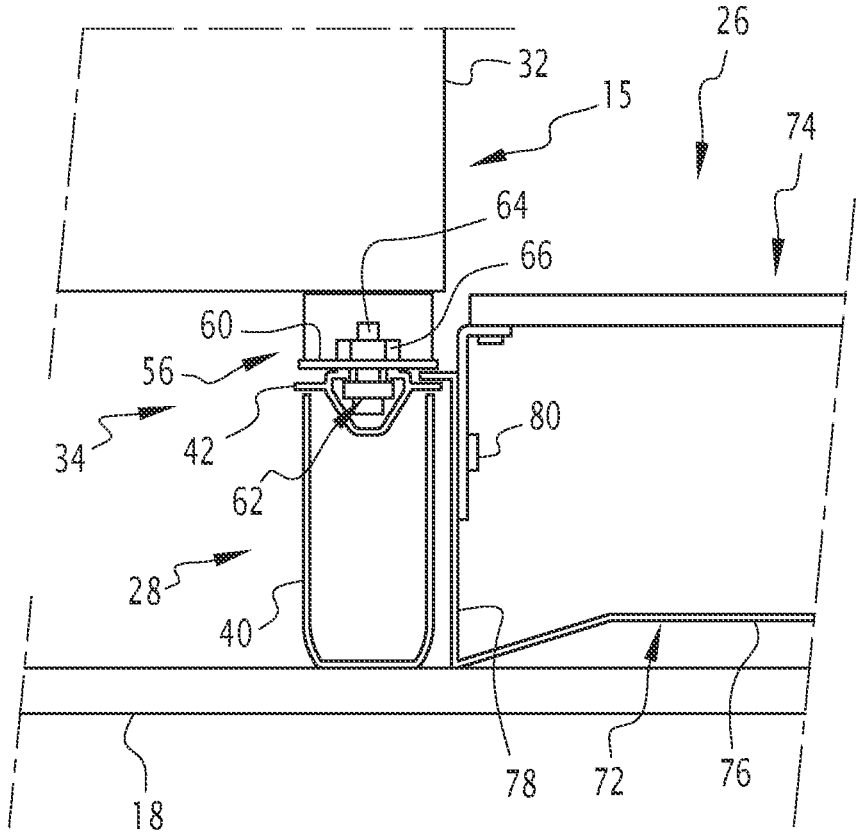
FIG. 2 is a detail view of the power car of FIG. 1.

FIG. 2 shows a detail view of both a rail 28 and the second device 34 for removable joining of a technical cabinet 15, assembled to one another.

Figure 3:
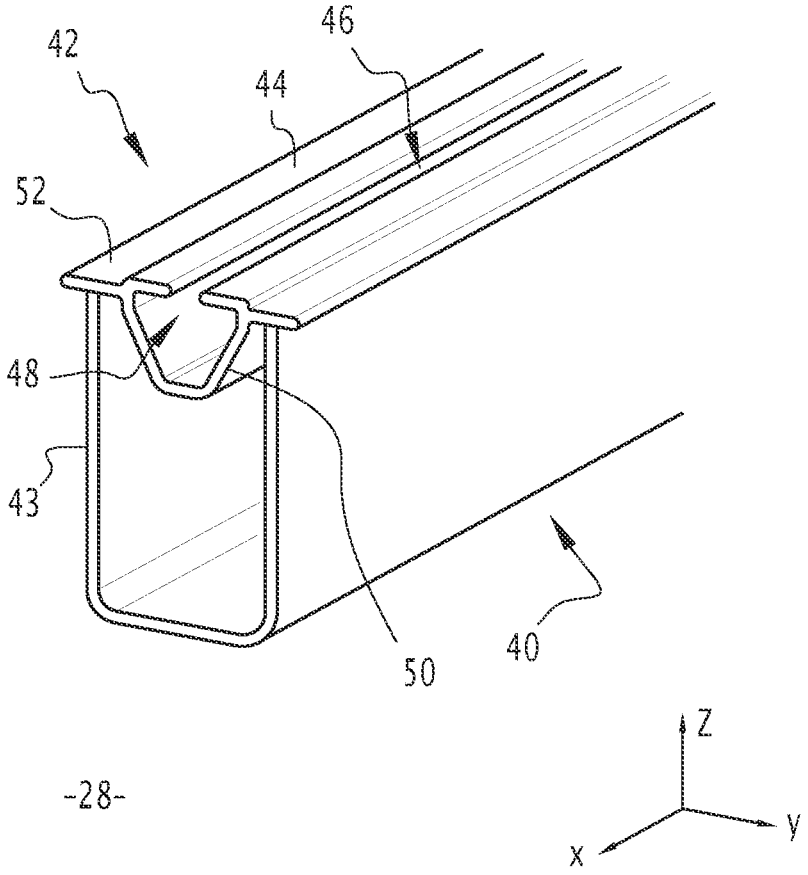
FIG. 3 is a perspective view of one element of the power car of FIGS. 1 and 2.

The rail 28, which is also visible in perspective view in FIG. 3, exhibits a substantially constant cross-section along X.

More specifically, in the depicted embodiment, the rail 28 comprises a lower element 40 and an upper element 42. Each of said lower 40 and upper 42 elements exhibits a constant cross-section, so that it can be manufactured from a single piece by bending and/or extrusion along X. The lower 40 and upper 42 elements are, for instance, made of steel and/or stainless steel.

The lower element 40, which is intended to rest against the floor 18, exhibits a U-shaped cross-section, the branches 43 of the U pointing upward.

The upper element 42, intended to rest against the ends of the branches of the U, is configured for removable joining with the second joining device 34. In the embodiment depicted, the upper element 42 comprises a substantially horizontal upper wall 44, in which a longitudinal slot 46 is fashioned. Preferably, at least one first end 48 of said slot along X is an open end.

In the embodiment depicted, the upper element 42 comprises a substantially tubular groove 50, which the longitudinal slot 46 opens onto. The upper element further comprises two substantially flat wings 52, disposed on both sides of the groove 50, each wing resting on one branch 43 of the U of the lower element 40.

For instance, the lower element 40 is created by bending a metal plate, and the upper element 42 is created by extrusion, the two elements then being welded to one another.

The second joining device 34 of the technical cabinet 15 comprises at least one foot 56, extending substantially vertically under the box 32. Preferably, the second joining device 34 comprises at least two substantially identical feet 56, aligned along a first edge 58 of the box 32. The first edge 58 is oriented along X and adjacent to the central corridor 30.

The foot 56 comprises a bottom end in the form of a substantially horizontal plate 60, capable of resting on the upper wall 44 of the upper element 42 of the rail 28. The plate 60 is equipped with a means 62 of fastening to said upper wall 44.

In the depicted embodiment, the means of fastening 62 is a removable tightening device of a bold type, comprising: A tightening rod 64, which passes through the longitudinal slot 46 and the plate 60 of the foot 56; and a nut 66 joined to the tightening rod 64 above said plate 60.

In a loosened configuration of the nut 66, the means of fastening 62 is able to slide along X within the longitudinal slot 46. In a tightened configuration of said nut, the means of fastening 62 fastens the foot 56 in a specific position along X on the rail 28.

The box 32 comprises a second edge 68, opposite the first edge 58 and adjacent to a side wall 20 of the body 12. In the depicted embodiment, the second edge 68 of the box 32 rests against a horizontal shoulder 70 extending along X along said side wall. According to one variant that is not depicted, the first joining device 24 further comprises third and fourth rails 28 in place of said shoulders 70 and the second joining device 34 comprises additional feet 56 on the second edge 68 of the box 32, for joining similar to that described above.

The cable tray 26 comprises a gutter 72 and upper slabs 74. The gutter 72, extending along X and disposed on the floor 18, is intended to accommodate equipment cables and/or channels (not depicted) of the power car 10.

The gutter 72 particularly comprises a floor 76, as well as substantially vertical risers 78. Preferably, the gutter 72 exhibits a substantially constant cross-section, so that it can be manufactured from a single piece by a step of bending. According to one embodiment, the floor 76 and risers 78 exhibit perforations (not depicted) disposed regularly along X and enabling joining with other elements.

The upper slabs 74 are disposed along the gutter 72. Preferably, said upper slabs 74 are distributed at regular intervals along said gutter, so as to form a support enabling an operator to pass through the central corridor 30 above the cables and/or channels housed in the gutter.

The upper slabs 74 are fastened to the risers 78 of the gutter by removable fasteners 80 of a screw or rivet type, particularly mating with perforations created in said risers.

The devices 24, 34 of removable joining described above constitutes a standardized system for equipping technical compartments of railway power cars or locomotives. This is because the rails 28 associated with the feet 56 make it possible to position the cabinets 15 in an infinite number of positions along the direction X. Identical rails 28 can therefore equip different power cars 10, regardless of the location chosen for the cabinets 15 in the technical compartment 22.

Likewise, the feet 56 can be associated with boxes 32 of different sizes. Finally, the same rail profile 28 is used along both sides of the central corridor 30, which makes it simpler to create the first joining device 24.

Likewise, the cable tray 26 used in association with the rails 28 exhibits a standard profile that is easy to adapt to different technical compartments 22.

The creation of the rails 28 by extrusion and by bending, and the gutter 72 by bending, make it possible to reduce production costs relative to the laser-cutting of metal plates, which is needed to produce the slatted sills of the prior art.

The invention claimed is:

1. A railway power car comprising a body extending in a longitudinal direction; the body comprising a floor and two side walls defining a technical room, the power car further comprising cabinets accommodated in the technical room, said cabinets capable of housing electrical and/or electronic and/or pneumatic equipment;

the power car further comprising at least two rails disposed on the floor, each of said rails extending in the longitudinal direction with a substantially constant cross-section, an upper part of each of said rails forming a first means of joining with one or more cabinets;

wherein each cabinet comprises at least one foot, said at least one foot comprising a second means of joining capable of mating with the first means of joining of one of said rails, wherein each first means of joining and each second means of joining are configured so that each cabinet can be fastened to said corresponding rail at an infinite number of positions along said rail;

wherein two of the rails are disposed on either side of a central corridor extending in the longitudinal direction in the technical room, the one or more cabinets being disposed along the side walls on both sides of said central corridor;

wherein the power car further comprises a gutter disposed on the floor in the central corridor, said gutter extending in the longitudinal direction, said gutter capable of accommodating equipment cables and/or channels of the power car; and wherein the gutter comprises perforations disposed at regular intervals in the longitudinal direction.

2. The railway power car according to claim 1, wherein the upper part of each of the rails exhibits a substantially constant cross-section in the longitudinal direction.

3. The railway power car according to claim 1, wherein the upper part of each of the rails exhibits a slot extending in the longitudinal direction and oriented upward.

4. The railway power car according to claim 3, wherein the second means of joining of the at least one foot of each cabinet is capable of being disposed in a tightened configuration and a loosened configuration, such that, in the loosened configuration, the second means of joining is able to slide into the slot of the upper part of one of the rails; and in the tightened configuration, the corresponding foot is translationally fixed relative to said rail.

5. The railway power car according to claim 1, wherein each rail comprises a lower part, said lower part exhibiting a constant cross-section so as to be able to manufactured from a single piece by extrusion and/or bending in the longitudinal direction.

6. The railway power car according to claim 5, wherein the lower parts of all the rails are substantially identical.

7. The railway power car according to claim 1, further comprising plates assembled above the gutter and distributed along the longitudinal direction.

8. A railway vehicle comprising the railway power car according to claim 1.

9. The railway power car according to claim 1, wherein the upper parts of all the rails are substantially identical.

* * * * *